US009540785B1

(12) United States Patent
Kamado et al.

(10) Patent No.: US 9,540,785 B1
(45) Date of Patent: Jan. 10, 2017

(54) WORKING VEHICLE AND WORKING VEHICLE CONTROL METHOD

(71) Applicant: KOMATSU LTD., Tokyo (JP)

(72) Inventors: Mitsuhiko Kamado, Hirakata (JP); Takashi Sugiguchi, Neyagawa (JP); Shinya Arimatsu, Takatsuki (JP); Yuki Sugimura, Ikoma (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/909,861

(22) PCT Filed: Aug. 18, 2015

(86) PCT No.: PCT/JP2015/073124
§ 371 (c)(1),
(2) Date: Feb. 3, 2016

(87) PCT Pub. No.: WO2015/199249
PCT Pub. Date: Dec. 30, 2015

(51) Int. Cl.
*E02F 9/20* (2006.01)
*E02F 3/43* (2006.01)
(Continued)

(52) U.S. Cl.
CPC ..... *E02F 3/431* (2013.01); *E02F 9/0841* (2013.01); *E02F 9/0866* (2013.01);
(Continued)

(58) Field of Classification Search
CPC ..... E02F 3/431; E02F 9/0866; E02F 9/0841; E02F 9/2037; E02F 9/2095; E02F 9/268; E02F 3/32
See application file for complete search history.

(56) References Cited

U.S. PATENT DOCUMENTS 4,077,484 A * 3/1978 Dezelan ..... B60K 17/356 180/242
2007/0214782 A1 9/2007 Komiyama et al.
(Continued)

FOREIGN PATENT DOCUMENTS

JP 2007-247230 A 9/2007
JP 2010-285828 A 6/2009
(Continued)

OTHER PUBLICATIONS

International Search Report for the corresponding international application No. PCT/JP2015/073124, issued on Oct. 6, 2015.
(Continued)

*Primary Examiner* — Richard Camby
(74) *Attorney, Agent, or Firm* — Global IP Counselors, LLP

(57) ABSTRACT

A working vehicle includes a revolving pump output calculating section that calculates the revolving pump output where the output of an electric motor is converted to be the output of a hydraulic pump. A reduction amount determining section determines a reduction amount for the output of the hydraulic pump during the multiple operations based on the revolving pump output. A pump output determining section determines a value, where the reduction amount is subtracted from the output of the hydraulic pump which is determined according to the state with the multiple operations, in a first control mode as the output of the hydraulic pump during the multiple operations. The pump output determining section increases the output of the hydraulic pump during the multiple operations in a second control mode more than in the first control mode.

8 Claims, 7 Drawing Sheets

(51) Int. Cl.

| | |
|---|---|
| ***E02F 9/08*** | (2006.01) |
| ***E02F 9/26*** | (2006.01) |
| *E02F 3/32* | (2006.01) |

(52) U.S. Cl.

CPC ..... *E02F 9/2037* (2013.01); *E02F 9/2095* (2013.01); *E02F 9/268* (2013.01); *E02F 3/32* (2013.01)

(56) References Cited

U.S. PATENT DOCUMENTS

| | | | | |
|---|---|---|---|---|
| 2012/0177470 | A1 | 7/2012 | Ohhigashi et al. | |
| 2012/0315119 | A1 | 12/2012 | Magaki et al. | |
| 2013/0074486 | A1* | 3/2013 | McWethy ..... | E02F 3/964 60/428 |

FOREIGN PATENT DOCUMENTS

| | | | |
|---|---|---|---|
| JP | 5044727 | B2 | 10/2012 |
| JP | 2012-255248 | A | 12/2012 |
| WO | 2011/145600 | A1 | 11/2011 |

OTHER PUBLICATIONS

Office Action for the corresponding Japanese application No. 2015-555305, issued on Jan. 19, 2016.

* cited by examiner

WORKING VEHICLE AND WORKING VEHICLE CONTROL METHOD

CROSS-REFERENCE TO RELATED APPLICATIONS

This application is a U.S. National stage application of International Application No. PCT/JP2015/073124, filed on Aug. 18, 2015.

The present invention relates to a working vehicle and a working vehicle control method.

A working vehicle has a revolving body and a work implement. The revolving body is revolved using a hydraulic motor and the work implement, such as a boom, is driven using a hydraulic cylinder in, for example, the working vehicle in Japanese Unexamined Patent Application Publication No. 2010-285828. In this type of working vehicle (referred to below as a "standard working vehicle"), the hydraulic motor and the hydraulic cylinder are driven using hydraulic fluid which is discharged from a hydraulic pump.

At the same time, hybrid working vehicles, where an electric motor is provided instead of the hydraulic motor as in Japanese Patent No. 5044727, are being developed in recent years. The revolving body is revolved using the electric motor and the work implement, such as a boom, is driven using the hydraulic cylinder in the hybrid working vehicle. The electric motor is driven using, for example, electrical power which is stored in a power storage apparatus. The hydraulic cylinder is driven using hydraulic fluid, which is discharged from the hydraulic pump. In this type of hybrid working vehicle, it is possible to improve fuel consumption compared to the standard working vehicle.

SUMMARY

The working vehicle performs various types of work using the work implement. Accordingly, it is desirable to improve the operation speed of the work implement in order to improve the workability. For example, an operation where the revolving body is revolved and the boom is raised is performed during working where a target object, such as sand which is dug up, is loaded onto a dump truck. During this type of multiple operations, it is desirable to improve the raising speed of the boom in order to improve the workability.

However, in the standard working vehicle, the output of the hydraulic pump is distributed between the hydraulic motor, which revolves the revolving body, and the hydraulic cylinder, which drives the work implement. Accordingly, there is a limit on improving of the operation speed of the hydraulic cylinder since a portion of the output of the hydraulic pump is used for driving the hydraulic motor.

The exemplary embodiments of the present invention improve fuel consumption and improve workability by increasing the operation speed of a work implement in a working vehicle during multiple operations.

A working vehicle according to one aspect of the present invention is provided with a vehicle body, an engine, a hydraulic pump, a work implement, a revolving body, an electric motor, a multiple operation detecting section, a control mode selecting section, a revolving pump output calculating section, and a pump output determining section. The vehicle body has a traveling body and a revolving body which is supported so that revolving is possible with regard to the traveling body. The engine is mounted in the vehicle body. The hydraulic pump is driven using the engine. The work implement has a hydraulic actuator. The hydraulic actuator is driven using hydraulic fluid which is discharged from the hydraulic pump. The electric motor revolves the revolving body.

The multiple operation detecting section detects a state with multiple operations where operating of the hydraulic actuator and the electric motor is carried out in combination. The control mode selecting section selects a control mode from a plurality of control modes which include a first control mode and a second control mode. The revolving pump output calculating section calculates the revolving pump output where the output of the electric motor is converted to be the output of the hydraulic pump. A reduction amount determining section determines a reduction amount for the output of the hydraulic pump during multiple operations based on the revolving pump output.

The pump output determining section determines a value, where the reduction amount is subtracted from the output of the hydraulic pump which is determined according to the state with multiple operations, in the first control mode as the output of the hydraulic pump during multiple operations. The pump output determining section increases the output of the hydraulic pump during multiple operations in the second control mode more than in the first control mode.

In the working vehicle according to this aspect, the hydraulic actuator is driven in the first control mode during multiple operations with an output which is reduced to the extent of the reduction amount which is determined based on the revolving pump output. For this reason, it is possible to improve fuel consumption during multiple operations. In addition, the output at which the hydraulic actuator is driven is equivalent to the output which is distributed to the hydraulic actuator in the standard working vehicle. For this reason, it is possible to suppress reductions in the operation speed of the hydraulic actuator compared to the standard working vehicle.

Furthermore, the hydraulic actuator is driven in the second control mode during multiple operations with an output which is larger than in the first control mode. For this reason, it is possible to increase the operation speed of the work implement during multiple operations and it is possible to consequently improve workability compared to the standard working vehicle.

It is desirable that the pump output determining section increases the output of the hydraulic pump during multiple operations to an extent which is equivalent to the reduction amount in the second control mode. In this case, it is possible to drive the hydraulic actuator in the second mode with an output which is larger to the extent of the output which is distributed to drive the hydraulic motor in the standard working vehicle. Due to this, it is possible to further improve workability by further increasing the operation speed of the work implement during multiple operations.

It is desirable that the pump output determining section increases the output of the hydraulic pump during multiple operations to an extent which is smaller than the reduction amount in the second control mode. In this case, it is possible to increase the operation speed of the work implement and it is possible to improve fuel consumption during multiple operations more than in the first control mode.

It is desirable that the working vehicle be further provided with a discharge pressure detecting section and a motor output determining section. The discharging pressure detecting section detects the discharge pressure of the hydraulic pump. The motor output determining section determines the output of the electric motor during multiple operations. It is desirable that the motor output determining section restrict the output of the electric motor in the first control mode according to the discharge pressure of the hydraulic pump. It is desirable that the motor output determining section does not perform restricting of the output of the electric motor according to the discharge pressure of the hydraulic pump in the second control mode. In this case, it is possible to drive the electric motor in the first control mode at the same output as the output which is distributed to the hydraulic motor in the standard working vehicle. In addition, it is possible to drive the electric motor in the second control mode with an output which is larger than the output which is distributed to the hydraulic motor in the standard working vehicle. Due to this, it is possible to further improve workability during multiple operations.

It is desirable that the work implement has a boom. It is desirable that the hydraulic actuator be a boom cylinder which drives the boom. In this case, it is possible to improve fuel consumption in the first control mode during so-called hoist revolving where revolving of the revolving body and driving of the boom are performed in combination. In addition, it is possible to improve workability by increasing the operation speed of the work implement in the second control mode during hoist revolving.

A control method according to another aspect of the present invention is a working vehicle control method. The control method according to this aspect is provided with first to sixth steps. The first step is detecting a state with multiple operations where operating of a hydraulic actuator for a work implement and an electric motor for revolving is carried out in combination. The second step is selecting a control mode from a plurality of control modes which include a first control mode and a second control mode. The third step is calculating the revolving pump output where the output of the electric motor is converted to be the output of a hydraulic pump.

The fourth step is determining a reduction amount for the output of the hydraulic pump during multiple operations based on the revolving pump output. The fifth step is determining a value, where the reduction amount is subtracted from the output of the hydraulic pump which is determined according to the state with multiple operations, in the first control mode as the output of the hydraulic pump during multiple operations. The sixth step is increasing the output of the hydraulic pump during multiple operations in the second control mode more than in the first control mode.

In the working vehicle control method according to this aspect, the hydraulic actuator is driven with an output which is reduced to the extent of the reduction amount which is determined based on the revolving pump output in the first control mode during multiple operations. For this reason, it is possible to improve fuel consumption during multiple operations. In addition, the output with which the hydraulic actuator is driven is equivalent to the output which is distributed to the hydraulic actuator in the standard working vehicle. For this reason, it is possible to suppress reductions in the operation speed of the hydraulic actuator compared to the standard working vehicle.

Furthermore, the hydraulic actuator is driven in the second control mode during multiple operations with an output which is larger than in the first control mode. For this reason, it is possible to increase the operation speed of the work implement during multiple operations and it is possible to consequently improve workability compared to the standard working vehicle.

According to exemplary embodiments of the present embodiment, it is possible to improve fuel consumption and improve workability by increasing the operation speed of a work implement in a work implement during multiple operations.

DESCRIPTION OF THE EXEMPLARY EMBODIMENTS

Figure 1:
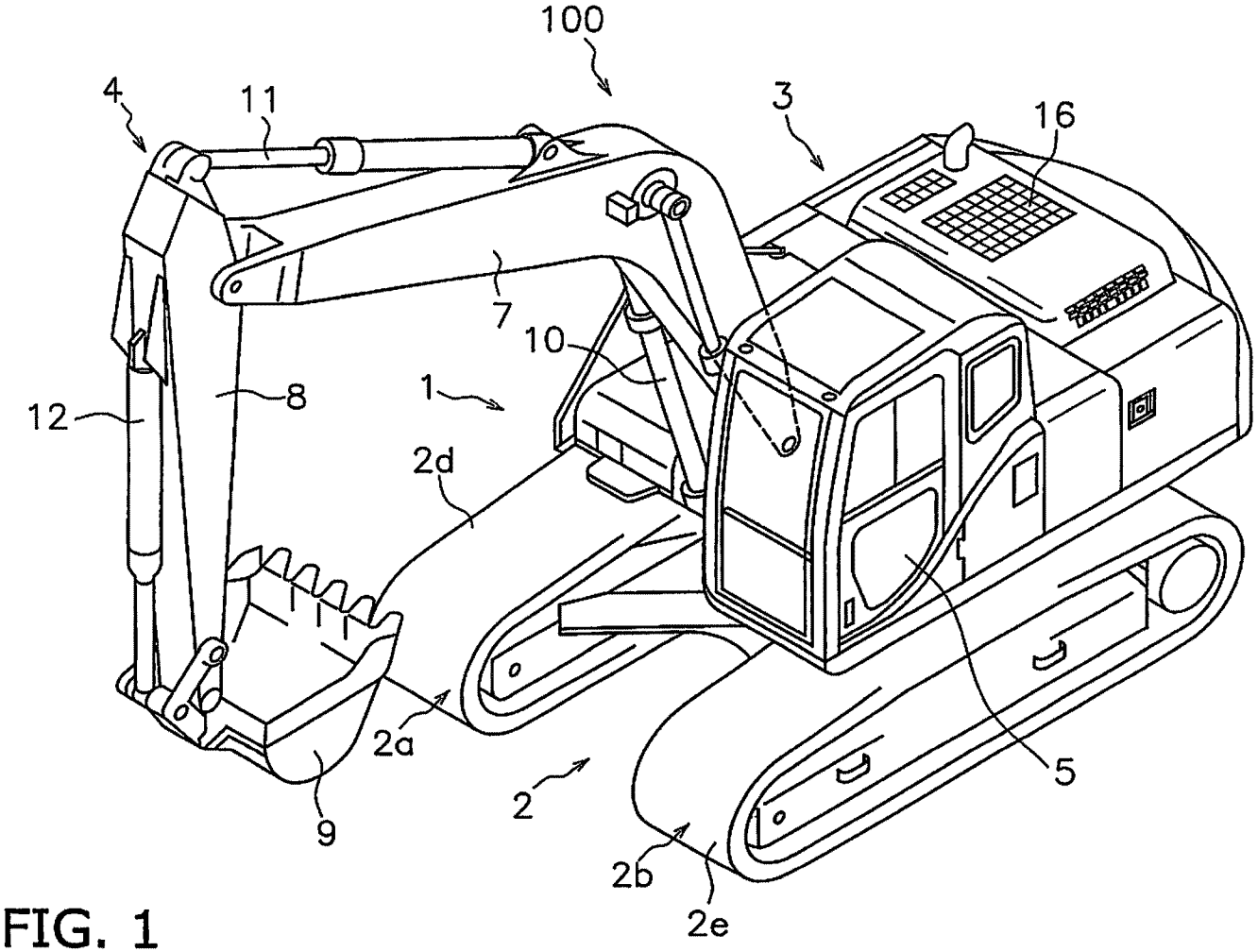
FIG. 1 is a perspective diagram of a working vehicle according to an exemplary embodiment.

A work vehicle according to an exemplary embodiment will be described below with reference to the diagrams. FIG. 1 is a perspective diagram of a work vehicle 100 according to the exemplary embodiment. In the present exemplary embodiment, the work vehicle 100 is a hydraulic excavator. The work vehicle 100 is provided with a vehicle body 1 and a work implement 4.

The vehicle body 1 has a traveling body 2 and a revolving body 3. The traveling body 2 has a pair of traveling apparatuses 2*a* and 2*b*. Each of the traveling apparatuses 2*a* and 2*b* have tracks 2*d* and 2*e*. The work vehicle 100 travels due to the traveling apparatuses 2*a* and 2*b* driving the tracks 2*d* and 2*e*.

The revolving body 3 is mounted on the traveling body 2. The revolving body 3 is provided so that revolving is possible with regard to the traveling body 2. The revolving body 3 is revolved due to being driven by a revolving electric motor 32 (refer to FIG. 2) which will be described later. A driving cab 5 is provided on the revolving body 3. The revolving body 3 has an engine chamber 16. The engine chamber 16 is arranged behind the driving cab 5. The engine chamber 16 accommodates equipment such as an engine 21 and a hydraulic pump 25 which will be described later.

The work implement 4 is attached to the revolving body 3. The work implement 4 has a boom 7, an arm 8, a working attachment 9, a boom cylinder 10, an arm cylinder 11, and an attachment cylinder 12. A base end portion of the boom 7 is joined to the revolving body 3 so that rotation is possible. A front end portion of the boom 7 is joined to a base end portion of the arm 8 so that rotation is possible. A front end portion of the arm 8 is joined to the working attachment 9 so that rotation is possible.

The boom cylinder 10, the arm cylinder 11, and the attachment cylinder 12 are hydraulic actuators which are driven using hydraulic fluid which is discharged from the hydraulic pump 25 which will be described later. The boom cylinder 10 operates the boom 7. The arm cylinder 11 operates the arm 8. The attachment cylinder 12 operates the working attachment 9. The work implement 4 is driven by the cylinders 10, 11, and 12 being driven. Here, the working attachment 9 is a bucket in the present exemplary embodiment, but may be another attachment, such as a crusher or a breaker.

Figure 2:
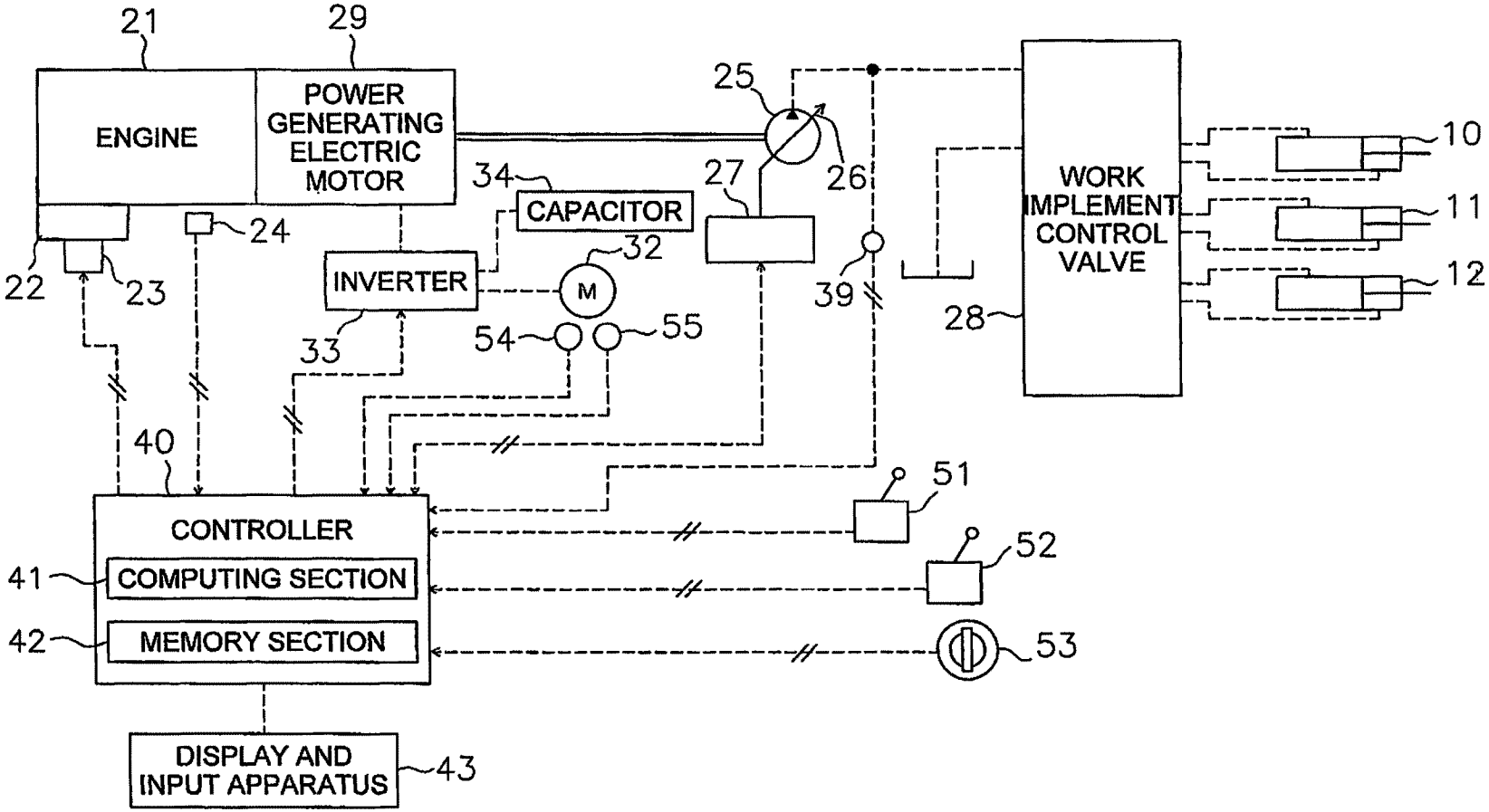
FIG. 2 is a schematic diagram illustrating an outline configuration of the working vehicle.

FIG. 2 is a schematic diagram illustrating an outline configuration of the working vehicle 100. The engine 21 is, for example, a diesel engine. The output horsepower of the engine 21 is controlled by adjusting the amount of fuel which is ejected into the inside of the cylinders of the engine 21. This adjusting is performed by controlling an electronic governor 23, which is installed in a fuel ejection pump 22 of the engine 21, using command signals from a controller 40. A variable speed control type of governor is typically used as the governor 23, and the engine rotation speed and the fuel ejection amount are adjusted according to the load so that the engine rotation speed is the target rotation speed which will be described later. That is, the governor 23 increases and decreases the fuel ejection amount so that there is no longer any difference between the target number of rotations and the actual number of engine rotations.

The actual rotation speed of the engine 21 is detected using an engine rotation speed sensor 24. The engine rotation speed which is detected using the engine rotation speed sensor 24 is input to the controller 40 which will be described later as a detection signal.

The drive shaft of the hydraulic pump 25 is joined with the output shaft of the engine 21. The hydraulic pump 25 is driven by the output shaft of the engine 21 being rotated. The hydraulic pump 25 is a variable capacity type of hydraulic pump. The capacity of the hydraulic pump 25 is changed due to changes in the tilting angle of a swash plate 26.

A pump control valve 27 is operated using command signals which are input from the controller 40 and the hydraulic pump 25 is controlled through a servo piston. The pump control valve 27 controls the tilting angle of the swash plate 26 so that the product of the discharge pressure of the hydraulic pump 25 and the capacity of the hydraulic pump 25 does not exceed the pump absorption torque which corresponds to command values (command current values) in the command signals which are input from the controller 40 to the pump control valve 27. That is, the pump control valve 27 controls the output torque of the hydraulic pump 25 according to the command current values which are input.

Hydraulic fluid which is discharged from the hydraulic pump 25 is supplied to the hydraulic actuators 10 to 12 via a work implement control valve 28. In detail, hydraulic fluid is supplied to the boom cylinder 10, the arm cylinder 11, and the attachment cylinder 12. Due to this, the boom 7, the arm 8, and the working attachment 9 are moved by the boom cylinder 10, the arm cylinder 11, and the attachment cylinder 12 being respectively driven.

The discharge pressure of the hydraulic pump 25 is detected using a discharge pressure detecting section 39. The hydraulic pressure of the hydraulic pump 25 which is detected using the discharge pressure detecting section 39 is input to the controller 40 as a detection signal.

The work implement control valve 28 is a flow amount and direction control valve which has a plurality of control valves which correspond to each of the hydraulic actuators 10 to 12. The work implement control valve 28 controls the flow amount of hydraulic fluid which is supplied to the hydraulic actuators 10 to 12.

The drive shaft of a power generating electric motor 29 is joined with the output shaft of the engine 21. The power generating electric motor 29 performs a power generating action and an electric moving action. The power generating electric motor 29 is connected with the revolving electric motor 32 and a capacitor 34 which is a power storage apparatus via an inverter 33. Electrical power is stored in the capacitor 34 by the power generating electric motor 29 performing a power generating action. The capacitor 34 supplies electrical power to the revolving electric motor 32. The capacitor 34 supplies electrical power to the power generating electric motor 29 when the power generating electric motor 29 is performing an electric moving action. The revolving electric motor 32 is driven by electrical power being supplied from the capacitor 34 and revolves the revolving body 3 described above. Here, without being limited to the capacitor, another power storage apparatus, such as a battery, may be used.

The torque of the power generating electric motor 29 is controlled using the controller 40. Power generation is performed by a portion of the output torque which is generated using the engine 21 being transferred to the drive shaft of the power generating electric motor 29 and the torque of the engine 21 being absorbed when the power generating electric motor 29 is controlled to perform a power generating action.

Alternating current electrical power which is generated using the power generating electric motor 29 is converted to direct current electrical power using the inverter 33 and is supplied to the capacitor 34. Direct current electrical power which is stored in the capacitor 34 is converted to alternating current electrical power using the inverter 33 and is supplied to the power generating electric motor 29 when the power generating electric motor 29 is controlled to perform an electric moving action. Due to this, the drive shaft of the power generating electric motor 29 is driven to rotate and torque is generated using the power generating electric motor 29. This torque is transferred from the drive shaft of the power generating electric motor 29 to the output shaft of the engine 21 and is added to the output torque of the engine 21. The power generation amount (absorption torque amount) and the power release amount (assist amount; generating torque amount) of the power generating electric motor 29 are controlled according to command signals from the controller 40.

The inverter 33 supplies electrical power which is generated in a case where the power generating electric motor 29 carries out a power generating action or electrical power which is stored in the capacitor 34 to the revolving electric motor 32 by converting the electrical power to electrical power which is the desired voltage, frequency, and number of phases which are appropriate for the revolving electric motor 32. Here, the motive energy of the revolving body 3 is converted to electrical energy in a case where the revolving operation of the revolving body 3 is decelerated or braking is applied. This electrical energy which is regenerated electrical power is stored in the capacitor 34 or is supplied as electrical power for the power generating electric motor 29 to carry out an electric moving action.

Operating apparatuses 51 to 53 and a display and input apparatus 43 are provided in the driving cab 5. The operating apparatuses 51 to 53 have a first operating apparatus 51, a second operating apparatus 52, and a target rotation speed setting apparatus 53.

The first operating apparatus 51 is operated by an operator to move the revolving body 51. The first operating apparatus 51 has, for example, an operating member, such as a lever. An operation signal which indicates the operating direction and the operating amount of the first operating apparatus 51 is input to the controller 40. That is, a revolving operation signal, which indicates the right revolve operating amount or the left revolve operating amount according to the operating direction and the operating amount with regard to a neutral position of the first operating apparatus 51, is input to the controller 40.

The controller 40 controls electrical power which is supplied from the capacitor 34 to the revolving electric motor 32 according to the operating amount of the first operating apparatus 51. Due to this, the revolving body 3 is revolved at a speed according to the operating amount of the first operating apparatus 51. In addition, the revolving body 3 is revolved in a direction according to the operating direction of the first operating apparatus 51.

The first operating apparatus 51 may also be used as an operating apparatus for the arm 8 according to the operating direction. For example, operating in the left and right direction and operating in the front and back direction using the first operating apparatus 51 may be allocated to operating of the arm 8 and operating of the revolving body 3. In this case, the work implement control valve 28 described above modifies the area which is open in the control valve which controls the arm cylinder 11 according to the operating amount of the first operating apparatus 51. Due to this, the arm 8 is moved at a speed according to the operating amount of the first operating apparatus 51. The arm cylinder 11 expands and contracts according to the operating direction of the first operating apparatus 51.

The second operating apparatus 52 is operated by an operator to move the boom 7. The second operating apparatus 52 has, for example, an operating member, such as a lever. An operation signal which indicates the operating direction and the operating amount of the second operating apparatus 52 is input to the controller 40. That is, a boom operation signal, which indicates the operating amount for raising the boom or the operating amount for lowering the boom according to the operating direction and the operating amount with regard to a neutral position of the second operating apparatus 52, is input to the controller 40.

The work implement control valve 28 modifies the area which is open in the control valve which controls the boom cylinder 10 according to the operating amount of the second operating apparatus 52. Due to this, the boom 7 is moved at a speed according to the operating amount of the second operating apparatus 52. In addition, the boom cylinder 10 expands and contracts according to the operating direction of the second operating apparatus 52.

The second operating apparatus 52 may also be used as an operating apparatus for the working attachment 9 according to the operating direction. For example, operating in the left and right direction and operating in the front and back direction using the second operating apparatus 52 may be allocated to operating of the boom 7 and operating of the working attachment 9. In this case, the work implement control valve 28 modifies the area which is open in the control valve which controls the attachment cylinder 12 according to the operating amount of the second operating apparatus 52. Due to this, the working attachment 9 is moved at a speed according to the operating amount of the second operating apparatus 52. In addition, the attachment cylinder 12 expands and contracts according to the operating direction of the second operating apparatus 52.

The target rotation speed setting apparatus 53 is an apparatus for setting the target rotation speed for the engine 21. The target rotation speed setting apparatus 53 has, for example, an operating member such as a dial. It is possible for an operator to manually set the target operation speed for the engine 21 by the target rotation speed setting apparatus 53 being operated. The content for operating of the target rotation speed setting apparatus 53 is input to the controller 40 as an operation signal.

The display and input apparatus 43 functions as a display apparatus which displays information on the working vehicle 100 such as the engine rotation speed. In addition, the display and input apparatus 43 has a touch panel monitor and also functions as an input apparatus which is manipulated by an operator.

The controller 40 is realized using a computer which has a memory section 42, such as a RAM and a ROM, and a computing section 41, such as a CPU. The controller 40 carries out programs to control the engine 21 and the hydraulic pump 25. Here, the controller 40 may be realized using a plurality of computers.

Figure 3:
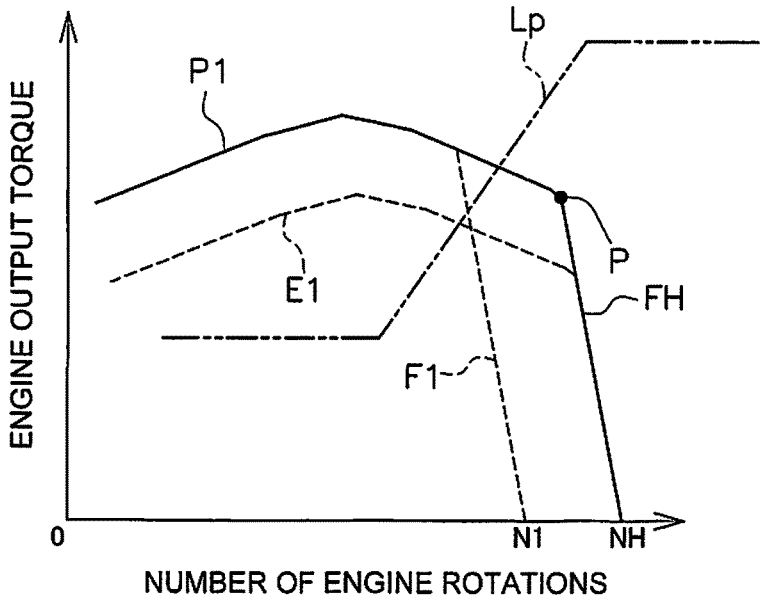
FIG. 3 is a diagram illustrating an engine output torque line and a pump absorption torque line.

The controller 40 performs control of the engine 21 based on engine output torque lines as shown by P1 or E1 in FIG. 3. The engine output torque lines represent upper limit values for torque which the engine 21 is able to output according to the rotation speed. That is, the engine output torque lines stipulate the relationship between the engine rotation speed and the maximum value for the output torque of the engine 21. The governor 23 controls the output of the engine 21 so that the output torque of the engine 21 does not exceed the engine output torque lines. The engine output torque lines are stored in the memory section 42 of the controller 40.

The controller 40 sends command signals to the governor 23 so that the engine rotation speed is the target rotation speed which is set. FH in FIG. 3 expresses a maximum speed regulation line when the target rotation speed is at a maximum target rotation speed NH. F1 in FIG. 3 expresses a regulation line when the target rotation speed is at N1 which is smaller than NH. In this manner, the controller 40 modifies the engine output torque line according to the target rotation speed which is set.

The controller 40 calculates the target absorption torque for the hydraulic pump 25 according to the target rotation speed for the engine 21. The target absorption torque is set so that the output horsepower of the engine 21 and the absorption horsepower of the hydraulic pump 25 coincide. The controller 40 calculates the target absorption torque based on a pump absorption torque line as shown by Lp in FIG. 3. The pump absorption torque line stipulates the relationship between the engine rotation speed and the absorption torque of the hydraulic pump 25 and is stored in the memory section 42 of the controller 40.

In addition, the controller 40 selects the engine output torque line according to the working mode which is set. The working mode is set using the display and input apparatus 43 and there are a P mode and an E mode as the working modes.

The P mode is a working mode where the output torque of the engine 21 is large and which is excellent for workability. The first engine torque line P1 which is shown in FIG. 3 is selected in the P mode. The first engine torque line P1 is, for example, equivalent to the rating of the engine 21 and the maximum power output.

The E mode is a working mode where the output torque of the engine 21 is smaller than in the P mode and which is excellent for fuel consumption. The second engine torque line E1 which is shown in FIG. 3 is selected in the E mode. The output torque of the engine 21 is smaller in the second engine torque line E1 than in the first engine torque line P1.

In the working vehicle 100 according to the present exemplary embodiment, it is possible for an operator to select a control mode from a plurality of control modes with regard to the P mode described above. There are a first control mode and a second mode as the plurality of control modes. In the second control mode, the controller 40 controls the engine 21 using the first engine output torque line P1. In the first control mode, the output of the hydraulic pump 25 is reduced and the output torque of the engine 21 is reduced along with this as will be described later. That is, the output of the hydraulic pump 25 is increased in the second control mode more than in the first control mode.

Figure 4:
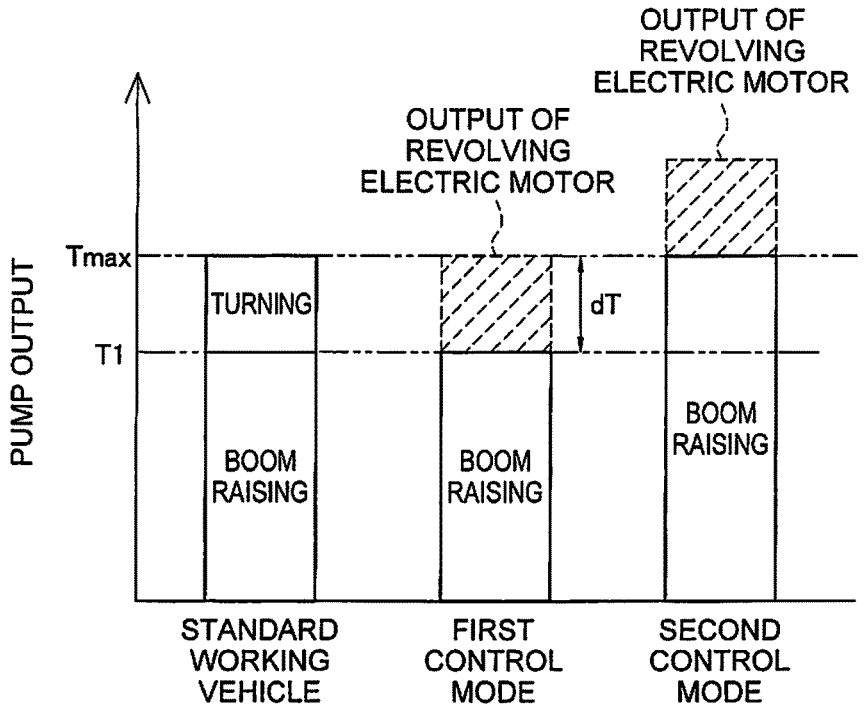
FIG. 4 is a diagram illustrating the output of a hydraulic pump in a first control mode and a second control mode during multiple operations.

FIG. 4 is a diagram illustrating the output of the hydraulic pump 25 in the first control mode and the second control mode during multiple operations. Here, multiple operations in the present exemplary embodiment has the meaning of multiple operations of revolving and raising the boom, and operating of the other hydraulic actuators is not performed.

In FIG. 4, Tmax is the maximum output of the hydraulic pump 25 which is determined using the pump absorption torque described above. In the first control mode, the output of the hydraulic pump 25 is reduced to a value T1 which is smaller than the maximum output Tmax as shown in FIG. 4. A reduction amount dT is determined based on the revolving pump output where the output of the revolving electric motor 23 is converted to be the output of the hydraulic pump 25. In the first control mode, the boom cylinder 10 is driven using the output T1 of the hydraulic pump 25.

In the second control mode, reduction of the output of the hydraulic pump 25 is not performed as in the first control mode and the maximum output Tmax is the output of the hydraulic pump 25. That is, in the second control mode, the output of the hydraulic pump 25 during multiple operations is increased more than in the first control mode to an extent which is equivalent to the reduction amount dT. In the second control mode, the boom cylinder 10 is driven using the maximum output Tmax. In detail, in the second control mode, the output of the hydraulic pump 25 is determined according to the operating amounts of the first operating apparatus 51 and the second operating apparatus 52. The maximum output Tmax is the maximum value for the output of the hydraulic pump 25 which is determined according to the operating amounts of the first operating apparatus 51 and the second operating apparatus 52.

Here, the maximum output Tmax is the maximum value for the output of the hydraulic pump 25 during a single operation where only the boom cylinder 10 is being operated without the revolving electric motor 32 being operated. The processes in the first control mode and the second control mode during multiple operations will be described below in detail.

Figure 5:
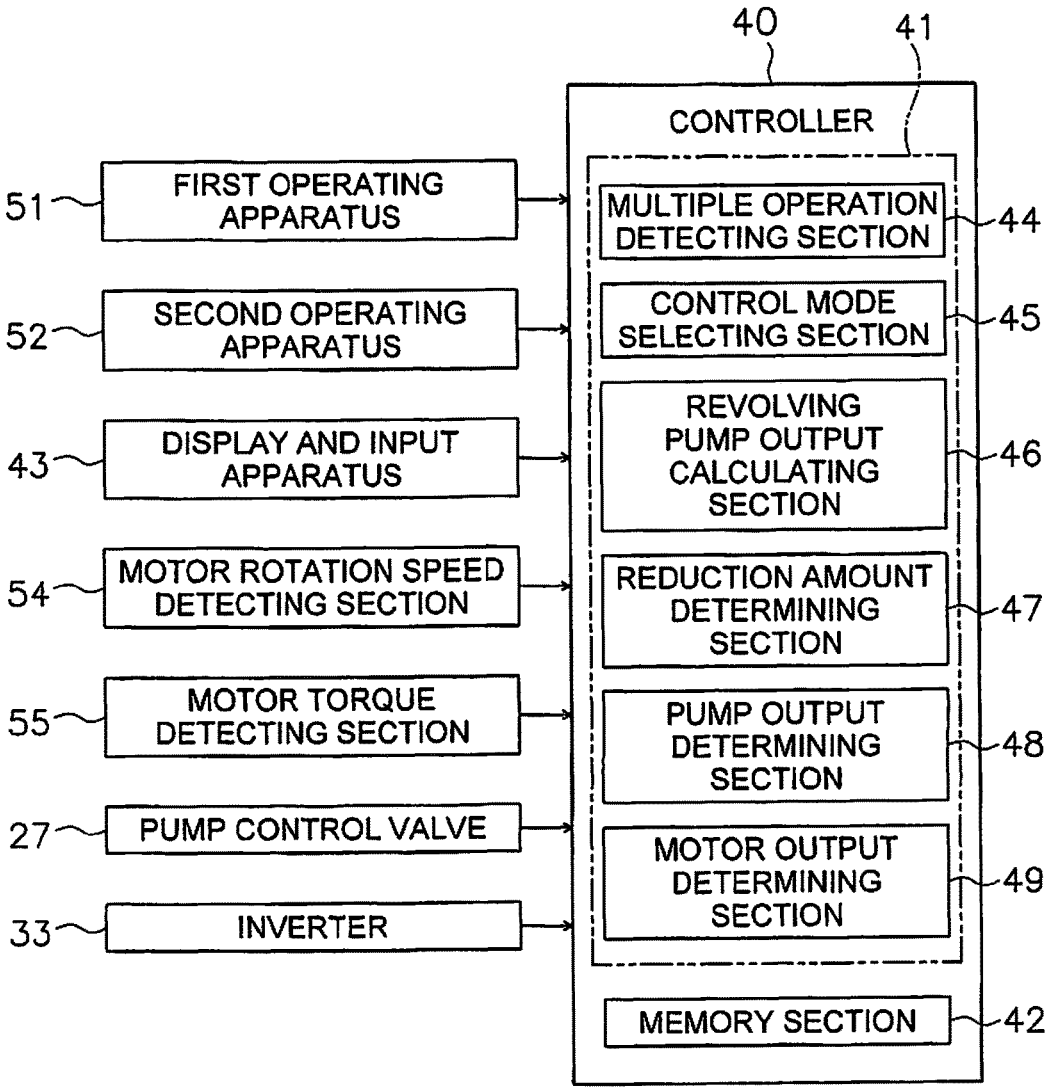
FIG. 5 is a block diagram illustrating a control system of the working vehicle.

FIG. 5 is a block diagram illustrating a control system of the working vehicle 100. A computing section 41 of the controller 40 has a multiple operation detecting section 44, a control mode selecting section 45, a revolving pump output calculating section 46, a reduction amount determining section 47, a pump output determining section 48, and a motor output determining section 49 as shown in FIG. 5.

Figure 6:
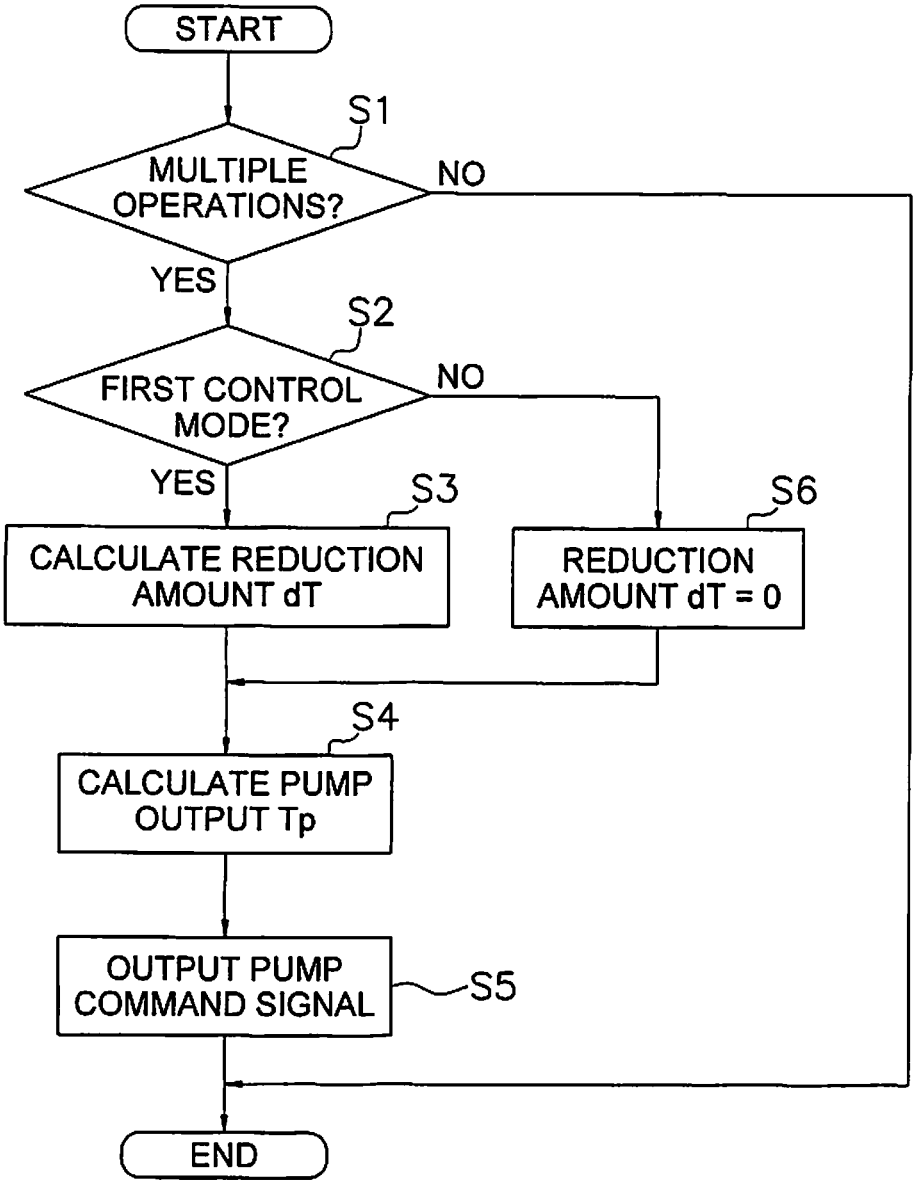
FIG. 6 is a flow chart illustrating control of a hydraulic pump during multiple operations.

FIG. 6 is a flow chart illustrating control of the hydraulic pump 25 during multiple operations. As shown in FIG. 6, in step S1, the multiple operation detecting section 44 detects whether or not operating of the boom cylinder 10 and the revolving electric motor 32 is carried out in combination. In detail, the multiple operation detecting section 44 detects whether or not a boom raising operation and a revolving operation are performed in combination. The multiple operation detecting section 44 ascertains whether or not there are multiple operations using detection signals from the first operating apparatus 51 and the second operating apparatus 52. The flow proceeds to step S2 when a boom raising operation and a revolving operation are being performed in combination.

In step S2, it is ascertained whether or not the first control mode is selected. It is possible for an operator to set either of the first control mode or the second control mode by the display and input apparatus 43 being manipulated. The control mode selecting section 45 receives a selection signal which indicates the control mode which is selected from the display and input apparatus 43 and sets the control mode which is selected as the control mode during multiple operations. The flow proceeds to step S3 when the first control mode is selected in step S2. The flow proceeds to step S6 when the first control mode is not selected, that is, when the second control mode is selected, in step S2.

In step S3, the reduction amount dT described above is calculated. The reduction amount dT is expressed using the following formula in equation 1.

$$dT=Ls\times\alpha \qquad \text{Equation 1}$$

α is a predetermined gain. In the first control mode, α is set to one or a value which is close to one. Ls is the revolving pump output. The revolving pump output calculating section 46 calculates the revolving pump output Ls by calculating the output of the revolving electric motor 32 by multiplying the rotation speed of the revolving electric motor 32 with the output torque of the revolving electric motor 32 and by converting this to the output of the hydraulic pump 25. The revolving pump output Ls is expressed using the following formula in equation 2.

$$Ls = Nm \times Tm \times \frac{1}{\rho} \qquad \text{Equation 2}$$

Nm is the rotation speed of the revolving electric motor 32. The rotation speed Nm of the revolving electric motor 32 is detected using the motor rotation speed detecting section 54. Tm is the output torque of the revolving electric motor 32. The output torque Tm of the revolving electric motor 32 is detected using the motor torque detecting section 55. ρ is the utility factor where the loss of hydraulic pressure is considered and is set to a predetermined value.

The reduction amount detecting section 47 calculates the reduction amount dT for the output of the hydraulic pump 25 during multiple operations from the revolving pump output LS described above and the formula in equation 1.

Next, in step S4, the pump output determining section 48 calculates output Tp of the hydraulic pump 25 during multiple operations. The output Tp of the hydraulic pump 25 during multiple operations is calculated using the following formula in equation 3.

$$Tp=T\max-dT \qquad \text{Equation 3}$$

That is, the pump output determining section 48 determines a value, where the reduction amount dT is subtracted from the maximum output Tmax of the hydraulic pump 25, in the first control mode as the output Tp of the hydraulic pump 25 during multiple operations. Then, in step S5, the controller 40 outputs a command signal, which corresponds to the output Tp of the hydraulic pump 25, to the pump control valve 27. As described above, the output Tp of the hydraulic pump 25 becomes the value T1 which is smaller than the maximum output Tmax in the first control mode as shown in FIG. 4.

When the second control mode is selected in step S2, the flow proceeds to step S6. In step S6, the reduction amount dT is set to zero. In detail, the reduction amount dT becomes zero due to the gain α described above being set to zero in the second control mode.

Then, in step S4, the output Tp of the hydraulic pump 25 during multiple operations becomes the maximum output Tmax in the second control mode due to the formula in equation 3 described above. That is, the pump output determining section 48 increases the output of the hydraulic pump 25 during multiple operations to an extent which is equivalent to the reduction amount dT in the second control mode.

Then, in step S5, the controller 40 outputs a command signal, which corresponds to the output Tp of the hydraulic pump 25, to the pump control valve 27. As described above, the output Tp of the hydraulic pump 25 becomes the maximum output Tmax in the second control mode as shown in FIG. 4.

Figure 7:
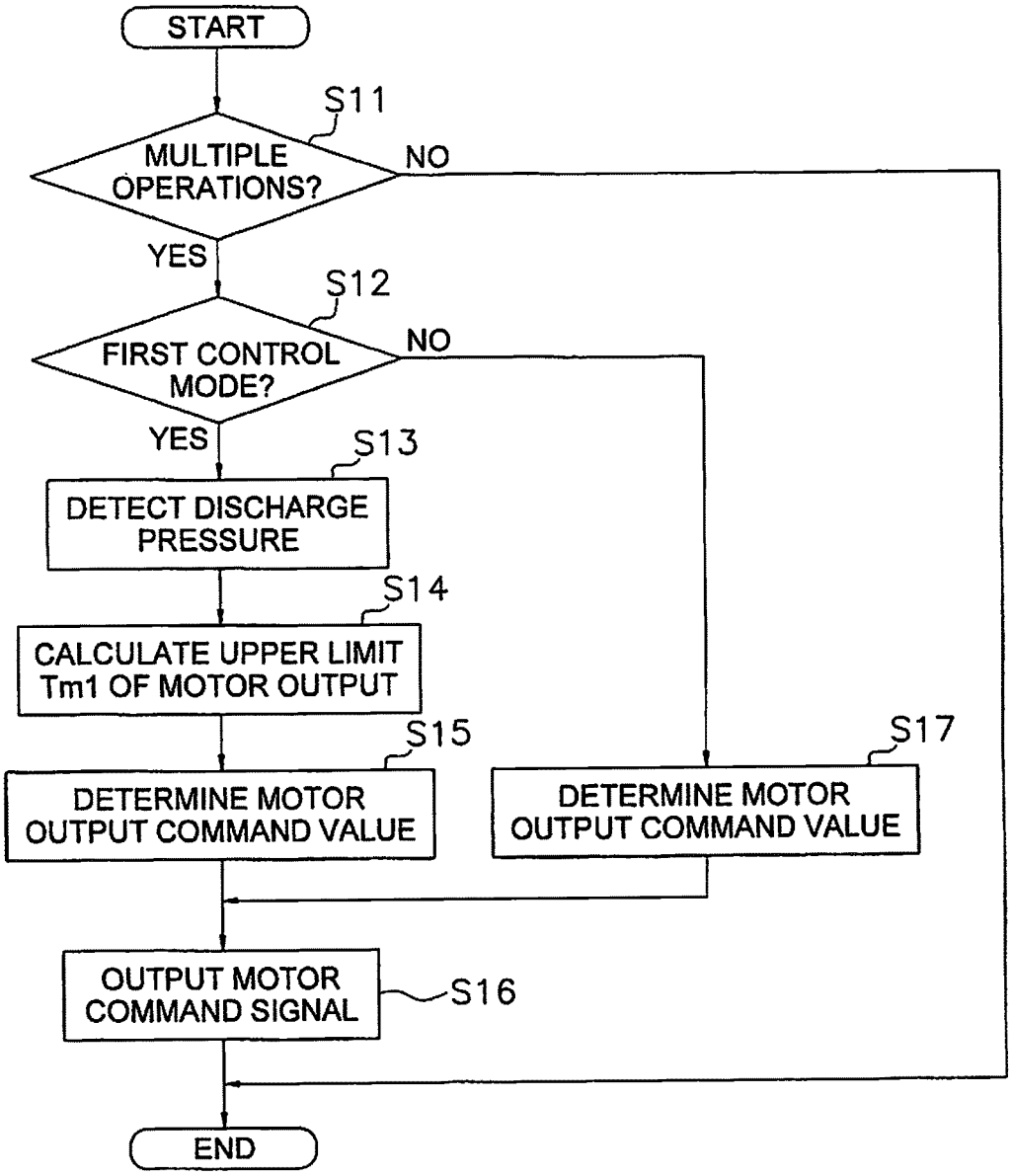
FIG. 7 is a flow chart illustrating control of a revolving electric motor during multiple operations.

Next, control of the revolving electric motor 32 in the first control mode and in the second control mode will be described. FIG. 7 is a flow chart illustrating control of the revolving electric motor 32 during multiple operations. The description of steps S11 and S12 is omitted since steps S11 and S12 in FIG. 7 are respectively the same as steps S1 and S2 in FIG. 6 described above.

When the first control mode is selected in step S12, restriction of the output of the revolving electric motor 32 is performed in steps S13 to S15. In detail, in step S13, the discharge pressure of the hydraulic pump 25 is detected. The discharge pressure of the hydraulic pump 25 is detected using the discharge pressure detecting section 39.

In step S14, an upper limit Tm1 for the motor output is calculated. Here, the motor output determining section 49 determines the upper limit Tm1 for the motor output according to the discharge pressure of the hydraulic pump 25. For example, the motor output determining section 49 reduces the upper limit Tm1 for the motor output as the discharge pressure of the hydraulic pump 25 becomes smaller.

Next, in step S15, a motor output command value is determined. Here, the motor output determining section 49 determines that the smaller out of a motor output Tm2 which is determining using the operating amount of the first operating apparatus 51 and the upper limit Tm1 for the motor output described above as the motor output command value. That is, the motor output determining section 49 restricts the output of the revolving electric motor 32 to be equal to or less than the upper limit Tm1 for the motor output according to the discharge pressure of the hydraulic pump 25 in the first control mode.

Then, in step S16, the controller 40 outputs a command signal, which corresponds to the motor output command value, to the inverter 33. In the standard working vehicle, the output of the hydraulic pump 25 which is distributed for revolving using the hydraulic motor is determined according to the discharge pressure of the hydraulic pump 25. For this reason, it is possible to obtain the output of the revolving electric motor 32 which is the same as the output of the hydraulic pump 25 for revolving in the standard working vehicle as shown by the dashed line in FIG. 4 by the upper limit Tm1 for the motor output being determined in the first control mode as described above.

When the second control mode is selected in step S12, restriction of the output of the revolving electric motor 32 as in steps S13 to S15 is not performed. Accordingly, in step S17, the motor output determining section 49 determines the motor output Tm2 which is determined using the operating amount of the first operating apparatus 51 as the motor output command value.

Then, in step S16, the controller 40 outputs a command value, which corresponds to the motor output command value, to the inverter 33. Due to this, in the second control mode, it is possible to obtain the output of the revolving electric motor 32 which is equal to or more than the output of the revolving electric motor 32 in the first control mode as shown by the dashed line in FIG. 4.

Here, the motor output determining section 49 does not perform restriction of the output of the revolving electric motor 32 according to the discharge pressure of the hydraulic pump 25 in the second control mode, but performing restriction of the output of the revolving electric motor 32 according to the remaining amount of electrical power in the capacitor 34 and the like are not excluded.

In the working vehicle 100 according to the present exemplary embodiment described above, the boom cylinder 10 is driven with an output which is reduced to the extent of the reduction amount which is determined based on the revolving pump output in the first control mode during multiple operations. For this reason, it is possible to improve fuel consumption during multiple operations. In addition, the output which is reduced is equivalent to the output which is distributed to drive the boom cylinder in the standard working vehicle. For this reason, it is possible to suppress reductions in the operation speed of the boom cylinder 10 compared to the standard working vehicle.

Furthermore, the boom cylinder 10 is driven in the second control mode during multiple operations with the maximum output Tmax without reduction of the output as in the first control mode being performed. For this reason, it is possible to improve workability by increasing the operation speed of the boom cylinder 10 during multiple operations.

One exemplary embodiment of the present invention is described above but the present invention is not limited to the exemplary embodiment described above and various modifications are possible within a scope which does not depart from the gist of the invention.

Figure 8:
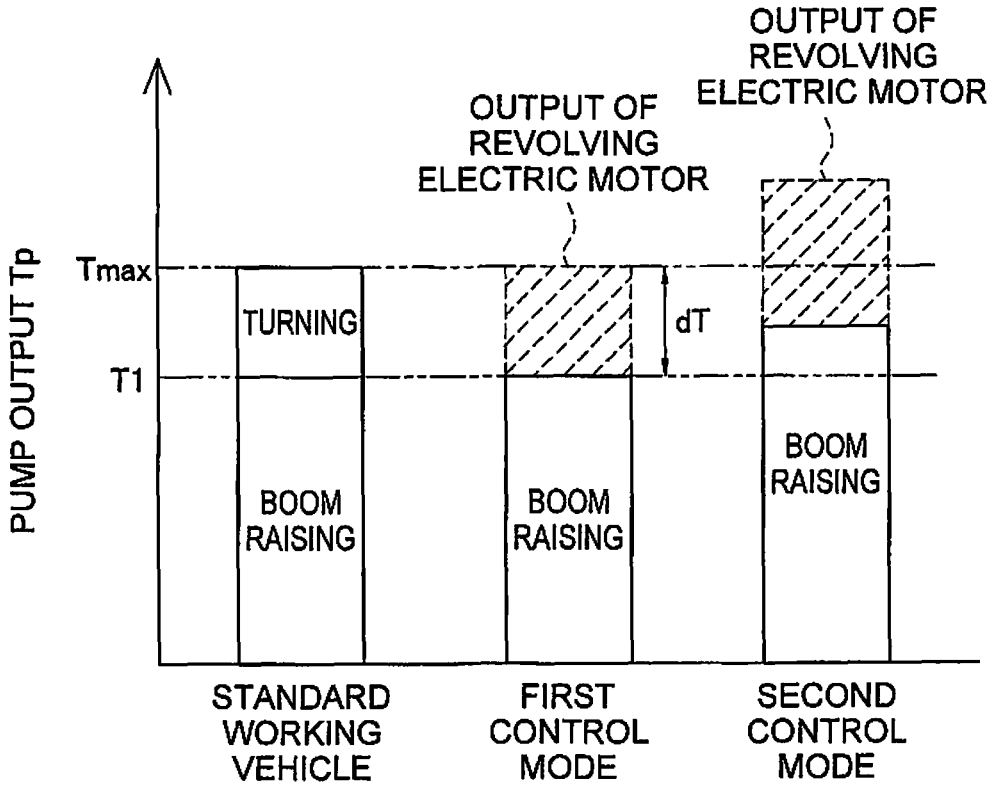
FIG. 8 is a diagram illustrating the output of a hydraulic pump in a first control mode and a second control mode during multiple operations according to another exemplary embodiment.

The pump output determining section 48 may increase the output of the hydraulic pump 25 during multiple operations to an extent which is smaller than the reduction amount dT in the second control mode. That is, the gain α in the formula in equation 1 may be set to a value which is larger than zero and smaller than one in the second control mode. In this case, the output Tp of the hydraulic pump 25 which is used to drive the boom cylinder 10 becomes a value which is between T1 and Tmax in the second control mode as shown in FIG. 8.

The control modes are not limited to two which are the first control mode and the second control mode and there may be three or more control modes. For example, the reduction amount dT in a third control mode may be a value which is between the first control mode and the second control mode.

The present exemplary embodiment is applied with regard to multiple operations of revolving and raising the boom in the exemplary embodiment described above, but the present invention may be applied with regard to multiple operations of revolving and operating of the work implement 4 other than raising the boom.

According to exemplary embodiments of the present invention, it is possible to improve fuel consumption and improve workability by increasing the operation speed of a work implement in a working vehicle during multiple operations.

The invention claimed is:

1. A working vehicle comprising:

a vehicle body including a traveling body and a revolving body rotatably supported by the traveling body;

an engine mounted in the vehicle body;

a hydraulic pump driven by the engine;

a work implement including a hydraulic actuator driven by hydraulic fluid discharged from the hydraulic pump;

an electric motor which rotates the revolving body;

a multiple operation detecting section which detects a state with multiple operations in which operating of the hydraulic actuator and the electric motor is carried out in combination;

a control mode selecting section which selects a control mode from a plurality of control modes including a first control mode and a second control mode;

a revolving pump output calculating section which calculates a revolving pump output which is an output of the hydraulic pump converted from an output of the electric motor;

a reduction amount determining section which determines a reduction amount for the output of the hydraulic pump during the multiple operations based on the revolving pump output; and a pump output determining section which determines a value, which is the maximum output of the hydraulic pump determined according to the state with the multiple operations minus the reduction amount, in the first control mode as the output of the hydraulic pump during the multiple operations and which increases the output of the hydraulic pump during the multiple operations in the second control mode more than in the first control mode.

2. The working vehicle according to claim 1, wherein the pump output determining section increases the output of the hydraulic pump during the multiple operations to an extent which is equivalent to the reduction amount in the second control mode.

3. The working vehicle according to claim 1, wherein the pump output determining section increases the output of the hydraulic pump during the multiple operations to an extent which is smaller than the reduction amount in the second control mode.

4. The working vehicle according to claim 1, further comprising a discharging pressure detecting section which detects a discharge pressure of the hydraulic pump; and a motor output determining section which determines the output of the electric motor during the multiple operations, the motor output determining section restricting the output of the electric motor in the first control mode according to the discharge pressure of the hydraulic pump and not performing restricting of the output of the electric motor according to the discharge pressure of the hydraulic pump in the second control mode.

5. The working vehicle according to claim 1, wherein the work implement includes a boom, and the hydraulic actuator is a boom cylinder which drives the boom.

6. A working vehicle control method comprising:

detecting a state with multiple operations in which operating of a hydraulic actuator for a work implement and an electric motor for revolving is carried out in combination;

receiving a selection signal which indicates a control mode which is selected from a plurality of control modes which includes a first control mode and a second control mode;

calculating a revolving pump output which is an output of a hydraulic pump converted from an output of the electric motor;

determining a reduction amount for the output of the hydraulic pump during the multiple operations based on the revolving pump output;

determining a value, which is the maximum output of the hydraulic pump determined according to the state with the multiple operations minus the reduction amount, in the first control mode as the output of the hydraulic pump during the multiple operations; and outputting a command signal for the hydraulic pump so that the output of the hydraulic pump during the multiple operations is increased in the second control mode more than in the first control mode.

7. The working vehicle according to claim 3, further comprising a discharging pressure detecting section which detects a discharge pressure of the hydraulic pump; and a motor output determining section which determines the output of the electric motor during the multiple operations, the motor output determining section restricting the output of the electric motor in the first control mode according to the discharge pressure of the hydraulic pump and does not perform restricting of the output of the electric motor according to the discharge pressure of the hydraulic pump in the second control mode.

8. The working vehicle according to claim 1, wherein the work implement includes a boom, and the hydraulic actuator is a boom cylinder which drives the boom.

* * * * *